US012245697B2

(12) United States Patent
Wolf

(10) Patent No.: US 12,245,697 B2
(45) Date of Patent: Mar. 11, 2025

(54) MOUNTED COLLAPSIBLE BENCH SEAT

(71) Applicant: Shawn Wolf, Corpus Christi, TX (US)

(72) Inventor: Shawn Wolf, Corpus Christi, TX (US)

( * ) Notice: Subject to any disclaimer, the term of this patent is extended or adjusted under 35 U.S.C. 154(b) by 0 days.

(21) Appl. No.: 17/939,691

(22) Filed: Sep. 7, 2022

(65) Prior Publication Data

US 2024/0074583 A1 Mar. 7, 2024

(51) Int. Cl.
*A47C 1/126* (2006.01)
*A47C 7/40* (2006.01)
*A47C 9/06* (2006.01)

(52) U.S. Cl.
CPC ..... *A47C 1/126* (2013.01); *A47C 7/407* (2013.01); *A47C 9/06* (2013.01)

(58) Field of Classification Search
CPC ..... A47C 1/126; A47C 9/06; A47C 7/407
USPC ..... 297/14
See application file for complete search history.

(56) References Cited

U.S. PATENT DOCUMENTS 2,257,211 A * 9/1941 Willoughby ..... B60N 2/3047 297/14
2,965,153 A * 12/1960 Purcell, Sr. ..... A47K 3/122 297/14
4,009,903 A * 3/1977 Manspeaker ..... A47C 4/06 297/14
4,632,457 A * 12/1986 Hofrichter ..... B60N 2/3047 248/240.1
4,682,438 A * 7/1987 Arrow ..... B63B 29/04 297/14
4,919,498 A * 4/1990 Turner ..... A47B 5/06 312/316
4,926,783 A * 5/1990 Lathers ..... B63B 29/04 297/14
5,185,892 A * 2/1993 Mitchell ..... A47K 3/122 297/14
5,655,459 A * 8/1997 O'Connor ..... A47B 5/06 108/134
5,720,522 A * 2/1998 Habeck ..... A47C 9/06 297/195.11
5,819,670 A * 10/1998 O'Connor ..... A47B 5/06 182/95
6,065,251 A * 5/2000 Kindrick ..... A47K 3/122 297/14
6,161,486 A * 12/2000 Boots ..... B25H 1/04 297/14

(Continued)

FOREIGN PATENT DOCUMENTS

CA 2895456 A1 * 12/2016 ..... A47C 3/34

*Primary Examiner* — Rodney B White
(74) *Attorney, Agent, or Firm* — Lyman Moulton, Esq.; Moulton Patents, PLLC

(57) ABSTRACT

The Shoe Stool is the only product of its kind that offers an independent foldable chair option, possessing adjustable height features, to suit the comfort of any individual who utilizes the accessory. The Shoe Stool is uniquely designed with either a single seat, double or triple seating selection and adjustable foldable legs to guarantee users are able to easily fold the chair back up for extra space when not in use. Furthermore, the Shoe Stool is carefully crafted with durable, high-quality materials such a light-weight steel or aluminum, can complement any décor, and uses a spring loaded lock pin that holds the seat securely, when positioned upright, to ensure functionality and long-term sustainability.

16 Claims, 7 Drawing Sheets

(56) References Cited

U.S. PATENT DOCUMENTS

| | | | | |
|---|---|---|---|---|
| 6,439,133 | B1 * | 8/2002 | Jaramillo | A47B 21/0314 108/44 |
| 6,460,922 | B1 * | 10/2002 | Demick | B60N 2/3068 297/14 |
| 6,729,685 | B1 * | 5/2004 | Ebalobor | A47C 9/06 297/14 |
| 6,807,690 | B1 * | 10/2004 | Satterfield | A47K 3/282 297/14 |
| 6,971,711 | B1 * | 12/2005 | Gast | A47C 9/06 297/14 |
| 7,080,417 | B2 * | 7/2006 | Jiang | A47C 9/06 297/14 X |
| 7,195,302 | B2 * | 3/2007 | Jovicevic | B60N 2/3047 297/14 |
| 7,594,701 | B2 * | 9/2009 | Kawabata | A47C 7/22 297/14 |
| 8,550,546 | B2 * | 10/2013 | Breit | A47C 4/20 297/14 |
| 9,629,450 | B1 * | 4/2017 | Howard | A47K 17/02 |
| 9,848,708 | B2 * | 12/2017 | Windsor | A47C 9/06 |
| 11,311,103 | B1 * | 4/2022 | Wilson | A47B 9/00 |
| 2014/0319275 | A1 * | 10/2014 | Najd | B60N 2/3018 297/14 |
| 2014/0375086 | A1 * | 12/2014 | Schliwa | B64D 11/06 297/14 |
| 2015/0335110 | A1 * | 11/2015 | Holmes | A45B 5/00 135/66 |
| 2016/0286961 | A1 * | 10/2016 | Windsor | A47C 1/121 |
| 2021/0100351 | A1 * | 4/2021 | Thomas | A47B 5/04 |

* cited by examiner

MOUNTED COLLAPSIBLE BENCH SEAT

BACKGROUND

Split-level entrance way homes often have limited room for a standard bench or chair for guests to sit on while placing shoes on or while removing them. As a result, guests will often have to perform the act while standing up, which can be difficult and inconvenient especially for those suffering from limited mobility and/or for the elderly, kids, those who are tall and/or overweight. There have been no products available as original equipment or as an aftermarket to address this problem.

An apparatus to provide convenient yet unobtrusive device to simplify the process and difficulty of removing or placing shoes on one's self is not being met by any known device or system at present. There have been no products available as original equipment or as an aftermarket to address this problem either.

SUMMARY OF THE INVENTION

The main purpose of the mounted collapsible bench is to provide users with an adjustable, mountable sitting stool, with fold away features, serving as a support device that facilitates putting on or taking off shoes, when needed.

Figure 1:
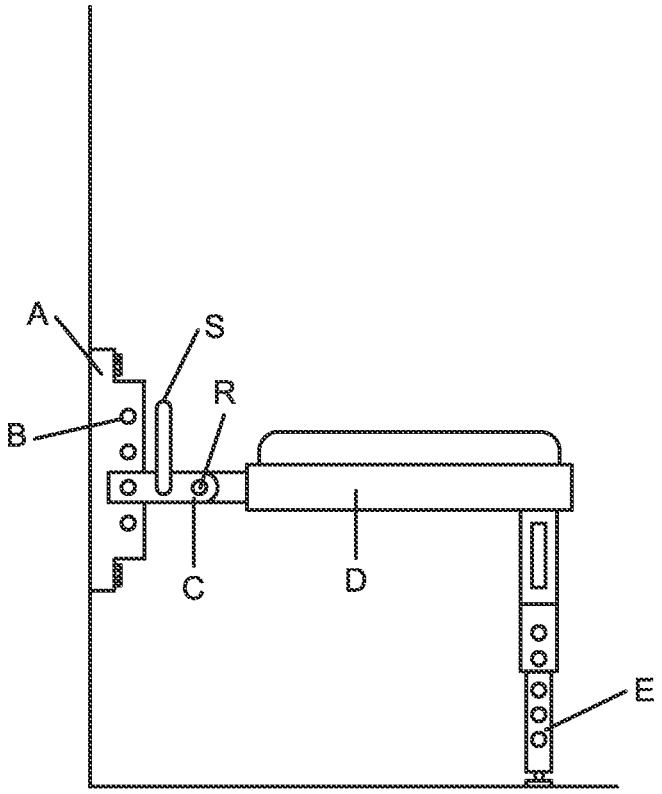
FIG. 1 is a right side view of the mounted collapsible bench extended for use in accordance with an embodiment of the present disclosure.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

FIG. 1 is a right side view of the mounted collapsible bench extended for use, showing: wall-mount bracket referenced as A, holes to adjust height of seat referenced as B, hinge referenced as C, folding seat referenced as D, bolt with a lock nut referenced as R, height adjustment swivel handle referenced as S, in accordance with an embodiment of the present disclosure.

Figure 2:
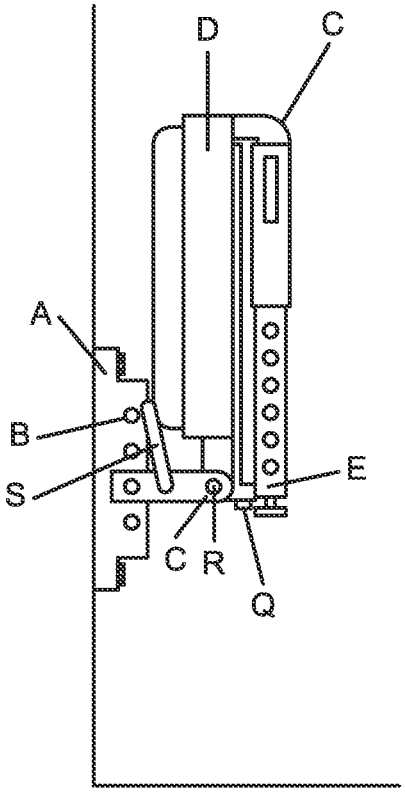
FIG. 2 is a right side view of the mounted collapsible bench, in the collapsed fold-away storage mode in accordance with an embodiment of the present disclosure.

FIG. 2 is a right side view of the mounted collapsible bench, in the collapsed fold-away storage mode, showing: wall-mount bracket referenced as A, holes to adjust height of seat referenced as B, hinge referenced as C, folding seat referenced as D, adjustable foldable legs referenced as E, seat lock pin to hold seat up right referenced as Q, bolt with a lock nut referenced as R, height adjustment swivel handle referenced as S, in accordance with an embodiment of the present disclosure.

Figure 3:
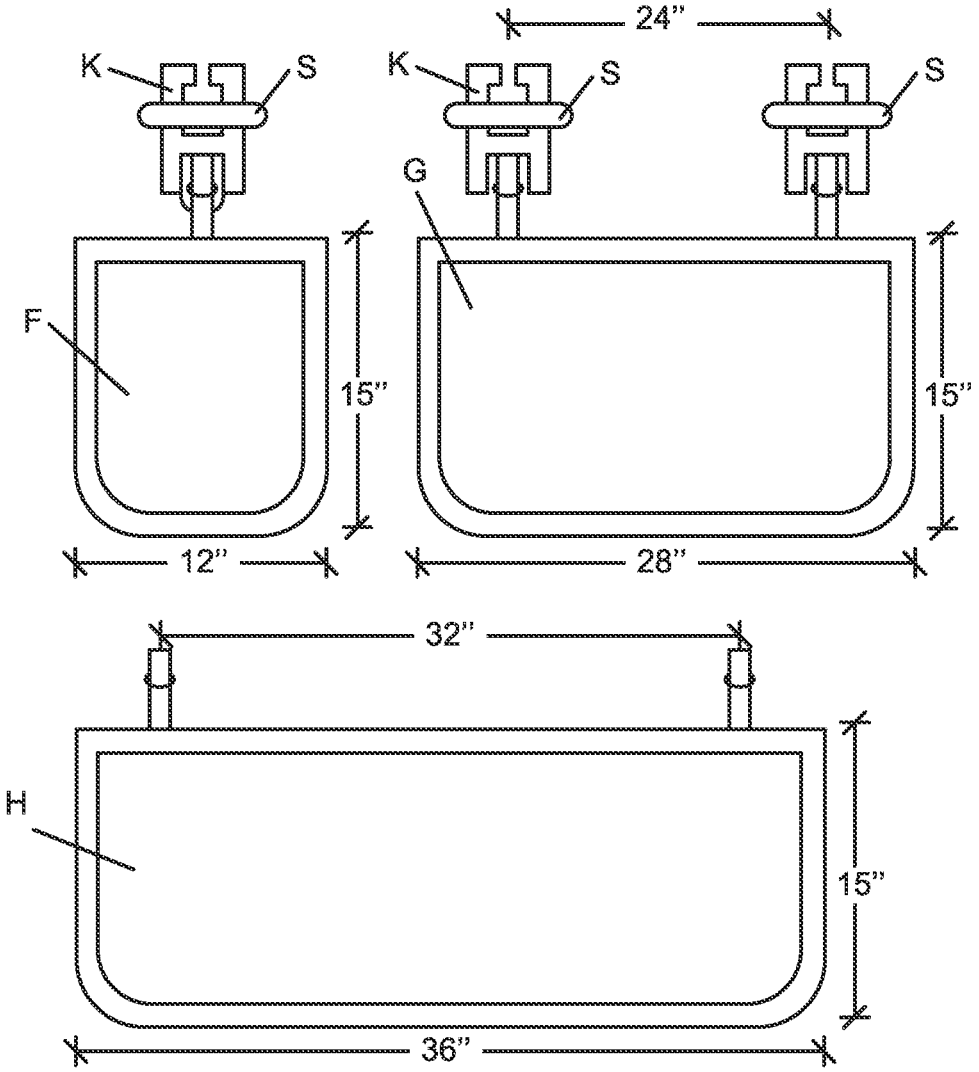
FIG. 3 is a top elevational view of a single, double and triple mounted collapsible bench in extended for use mode in accordance with an embodiment of the present disclosure.

FIG. 3 is a top elevational view of a single, double and triple mounted collapsible bench, in extended for use mode, showing: single seat referenced as F, double seat referenced as G, triple seat referenced as H, seat bracket (H-Bracket) with flat with a hole to lock seat up referenced as K, height adjustment swivel handle referenced as S, in accordance with an embodiment of the present disclosure.

Figure 4:
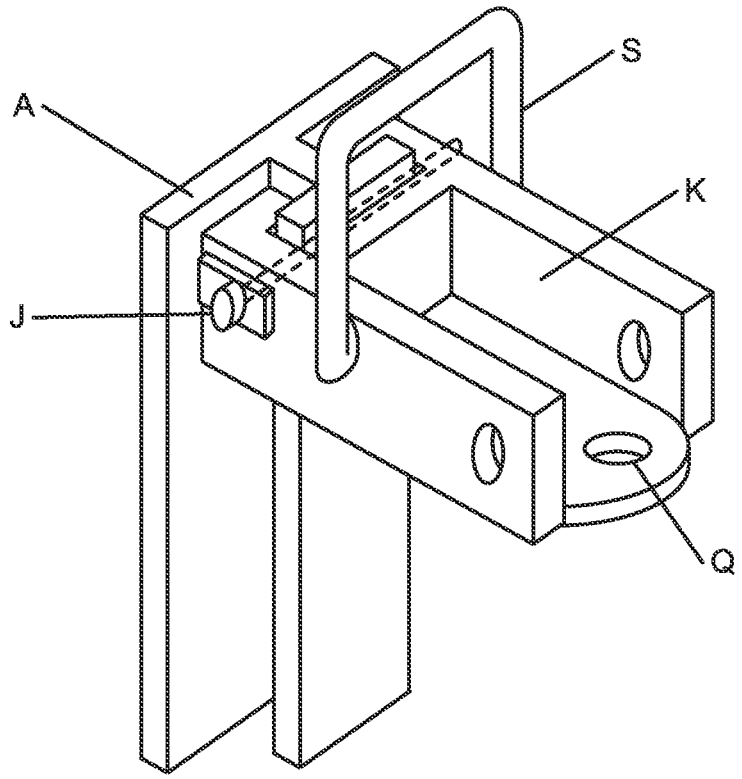
FIG. 4 is a right side perspective view of the mounted collapsible bench wall attachment mechanism in accordance with an embodiment of the present disclosure.

FIG. 4 is a right side perspective view of the mounted collapsible bench wall attachment mechanism, showing: wall-mount bracket referenced as A, T-pin referenced as J, seat bracket (H-Bracket) with flat with a hole to lock seat up referenced as K, seat lock pin to hold seat up right referenced as Q, height adjustment swivel handle referenced as S, in accordance with an embodiment of the present disclosure.

Figure 5:
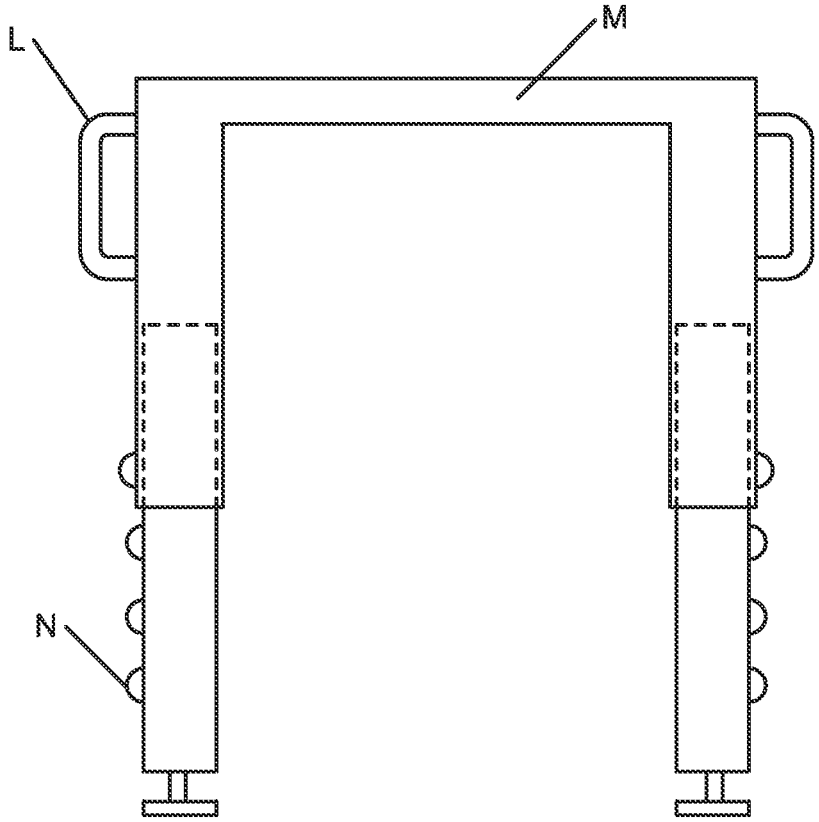
FIG. 5 is a front view of the mounted collapsible bench seat leg support apparatus in accordance with an embodiment of the present disclosure.

FIG. 5 is a front elevational view of the mounted collapsible bench seat leg support apparatus showing: side handle referenced as L, leg/seat assembly referenced as M, push-in pins for height adjustment referenced N, in accordance with an embodiment of the present disclosure.

Figure 6:
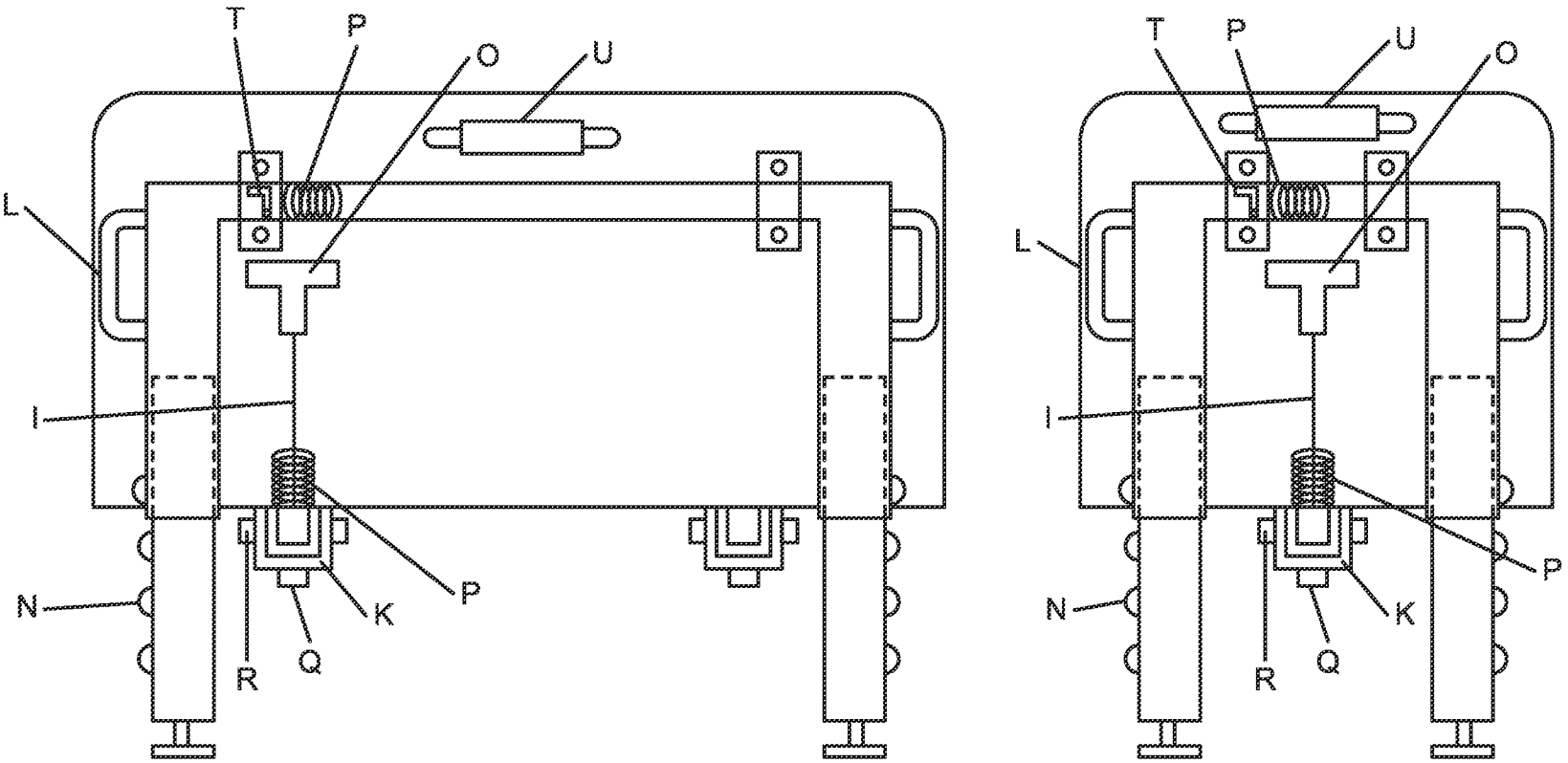
FIG. 6 is a back elevational view of a single and double mounted collapsible bench seat, collapsed into fold-away storage mode, in accordance with an embodiment of the present disclosure.

FIG. 6 is a back elevational view of a single and double mounted collapsible bench seat, collapsed into fold-away storage mode, showing: seat lock release cable referenced as I, seat bracket (H-Bracket) with flat with a hole to lock seat up referenced as K, side handle referenced as L, push-in pins for height adjustment referenced N, referenced as O, spring referenced as P, seat lock pin to hold seat up right referenced as Q, bolt with a lock nut referenced as R, leg lock referenced as T, under-seat rope handle with a grip referenced as U in accordance with an embodiment of the present disclosure.

Figure 7:
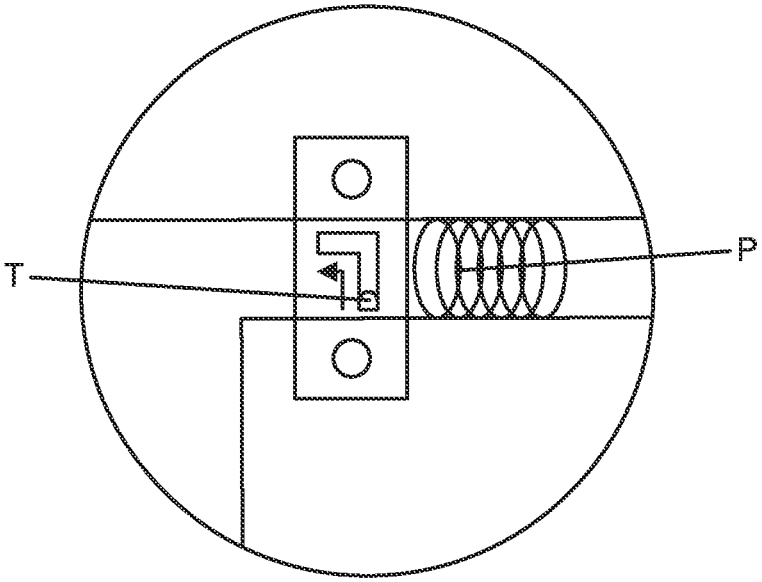
FIG. 7 is a close up, back elevational view of the leg lock portion of the mounted collapsible bench seat in accordance with an embodiment of the present disclosure.

FIG. 7 is a close up, back elevational view of the leg lock portion of the mounted collapsible bench seat showing: spring referenced as P, leg lock referenced as T, in accordance with an embodiment of the present disclosure.

The present disclosed mounted collapsible bench, also known as "The Shoe Stool", offers a modern accessory that guarantees individuals are able to formally sit down while taking off or putting on their shoes in areas where limited space restricts the placement of a standard chair and/or bench. Meant to complement any narrow area in a domestic or commercial setting, the Shoe Stool introduces a novel mountable seat that lifts up and down manually as it offers a device where the back mounts to a wall and the front possesses a fold-up seat or bench design. To use, one would simply pull on the foldable extension leg to lower the seating area. The leg is also strategically designed with a semipermanent height adjustment feature to ensure users are able to adjust the height accordingly during utilization and employs corresponding number markings for support to ensure comfortable seating. Once the shoes have been put on or taken off, users can simply fold the Shoe Stool bench back up, where a latch will hold the sectional piece, upright securely. This innovative, top-quality product ensures a fully operational fold-up seating device that is capable of seating up to four people and can easily be mounted onto the wall.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

What is claimed is:

1. A seat device comprising:

a. a wall bracket comprising an I-beam in cross section defining height holes in a web thereof and having an upper flange and an extended lower flange configured to mount to a wall;

b. a seat bracket comprising an H shape having arms to secure around the upper flange and legs to secure to the mounted seat and define lateral arm holes for pins to lock into the web holes and lateral leg holes;

c. a seat comprising a front side and a back side connected to the seat bracket via a hinge at the lateral leg holes swingable from a position where the seat is at a ninety degree angle relative to the wall to a position where the seat is in a parallel position relation to the wall; and d. a pair of foldable legs attached to the seat front side via at least one leg bracket in a ninety degree angle relative to the seat and swingable to a parallel position relative to the seat.

2. The seat device of claim 1, wherein the seat comprises a single sitting seat and a single wall bracket and a single seat bracket.

3. The seat device of claim 1, wherein the seat comprises a double sitting seat and two each wall brackets and two each seat brackets.

4. The seat device of claim 1, wherein the seat hinge further comprises a T pin configured to lock the seat in the position parallel to the wall and in the ninety degree angle relative to the wall.

5. The seat device of claim 4, further comprising a seat hinge release cable configured to release the T pin lock.

6. The seat device of claim 1, wherein the seat bracket further comprises a height adjustment swivel handle.

7. The seat device of claim 1, wherein the pair of legs further comprise a pair of handles disposed laterally on each leg of the pair of legs.

8. The seat device of claim 1, wherein each leg of the pair of legs comprise telescoping extensions and push pins for a height adjustment.

9. The seat device of claim 1, wherein the seat bracket further defines a bottom hole configured to receive a lock pin therein to lock the swinging movement of the seat.

10. The seat device of claim 1, further comprising a lock pin configured to lock the swingable relation to the wall.

11. The seat device of claim 1, wherein the at least one leg bracket of the pair of foldable legs is configured to lock the legs in one of the parallel position relative to the seat and in the ninety degree angle relative to the seat.

12. The seat device of claim 1, further comprising a rope handle with a grip portion thereof disposed on an underside of the seat.

13. The seat device of claim 1, wherein the seat is locked into the ninety degree angle relative to the wall and the pair of legs are locked into the ninety degree angle relative to the seat for use.

14. The seat device of claim 1, wherein the seat is locked into the parallel position relative to the wall and the pair of legs are locked into the parallel position relative with the seat for storage.

15. The seat device of claim 1, wherein a length of the pair of legs are adjustable in a height to match a height of the wall bracket set by the web holes in relation to a floor adjacent the wall.

16. The seat device of claim 1, further comprising a swivel handle configured to clamp the seat bracket H arms around the upper flange of the I-beam wall bracket.

* * * * *